US006969178B2

(12) United States Patent
Zuloff

(10) Patent No.: US 6,969,178 B2
(45) Date of Patent: Nov. 29, 2005

(54) PORTABLE BLACK LIGHT DEVICE

(76) Inventor: Steven Zuloff, 9314 Eton Ave., Chatsworth, CA (US) 91311

( * ) Notice: Subject to any disclaimer, the term of this patent is extended or adjusted under 35 U.S.C. 154(b) by 43 days.

(21) Appl. No.: 10/684,541

(22) Filed: Oct. 14, 2003

(65) Prior Publication Data

US 2005/0078473 A1 Apr. 14, 2005

(51) Int. Cl.[7] ..... F21V 21/084
(52) U.S. Cl. ..... 362/106; 362/105; 362/800; 2/209.13
(58) Field of Search ..... 362/105, 106, 362/800; 422/24; 2/109.13, 209.13

(56) References Cited

U.S. PATENT DOCUMENTS

| | | | | |
|---|---|---|---|---|
| 5,510,961 | A | 4/1996 | Peng | |
| 5,741,060 | A | 4/1998 | Johnson | |
| 5,921,674 | A | 7/1999 | Koczi | |
| 6,168,286 | B1 | 1/2001 | Duffy | |
| 6,554,444 | B2 | 4/2003 | Shimada et al. | |
| 6,579,495 | B1 * | 6/2003 | Maiden | 422/24 |
| 6,604,837 | B2 | 8/2003 | Sandberg | |
| 6,616,293 | B2 | 9/2003 | Mickey | |
| 6,659,618 | B2 | 12/2003 | Waters | |
| 6,733,150 | B1 * | 5/2004 | Hanley | 362/106 |
| 2003/0151910 | A1 | 8/2003 | Marston | |
| 2003/0231489 | A1 | 12/2003 | Hsiao | |
| 2004/0264176 | A1 * | 12/2004 | Vanderschuit | 362/106 |

* cited by examiner

*Primary Examiner*—Sandra O'Shea
*Assistant Examiner*—James W Cranson, Jr.
(74) *Attorney, Agent, or Firm*—Howard C. Miskin, Esq.; Gloria Tsui-Yip, Esq.

(57) ABSTRACT

A portable, self-contained, black light device that is incorporated into or adaptable to a head gear to be used in combination with fluorescent or phosphorescent material for entertaining effect or promotional purposes. The portable black light device has a housing with a plurality of openings, a plurality of UV LEDs protruding from each opening and a power source within the housing for energizing the UV LEDs. With the portable black light device incorporated or adaptable to the visor or brim of a head gear, and in combination with fluorescent paint or make up on a wearer's face or fluorescent decorative element, cause the fluorescent paint to glow as if internally lit, providing an effective entertainment or advertisement.

32 Claims, 13 Drawing Sheets

PORTABLE BLACK LIGHT DEVICE

FIELD OF THE INVENTION

The invention relates to an entertainment or promotional device relating to black light. In particular, a portable, self-contained, black light device that is incorporated into or adaptable to a head gear to be used in combination with fluorescent or phosphorescent material for entertaining effect or promotional purposes.

BACKGROUND OF THE INVENTION

Ultraviolet (UV) lights encompass lights having wavelengths of 4 to 400 nanometers. The longer wavelengths of the ultraviolet light spectrum are called black light, which have wavelengths slightly shorter than those that are normally visible and is generally safe for human viewing. Black light appears as a deep blue light because only a portion of the light has long enough wavelengths to be visible to human. For the purpose of this invention, blue black lights are simply called black light. An example of a shorter wavelength in the ultraviolet light spectrum is germicidal ultraviolet light that emits a much shorter wavelength that is dangerous to human skin and eyes.

The barely visible and invisible black light energizes fluorescent and/or phosphorescent pigments which then re-emits the light in visible colors. This results in the object appearing to have an independent glow as if internally lit. Black lights have been used as a source of illumination in theatrical productions, amusement park rides and home use for illuminating art covered with fluorescent and/or phosphorescent paint, and for general atmospheric effects for numerous years.

A black light source is generally a tube, similar to a fluorescent tube that produces white light, of a certain length and is not conveniently portable due to the size and the need of either alternating current or large voltage direct current. While black light has been used to illuminate all sorts of fluorescent or phosphorescent objects, black light as a portable device has not been used.

Using light emitting diodes (LEDs) that can produce UV black lights (generally known as UV LED), a portable black light device is provided. UV LEDs are similarly sized as typical prior art LEDs and can be powered by direct current such as batteries.

Therefore, there is a need for a portable black light device that can provide entertaining and promotional values.

SUMMARY OF THE INVENTION

The present invention provides a portable, self-contained small black light device that is incorporated into or adaptable to a head gear to be used in combination with fluorescent or phosphorescent material for entertaining effect or promotional purposes.

The portable black light device of the present invention comprises a housing having a plurality of openings, a plurality of UV LEDs are placed in each opening and a self-contained power source is within the housing.

In the preferred embodiment, the portable black light device is incorporated into a head gear with a brim or a visor with the housing shaped to conform with the brim or visor such that the plurality of UV LEDs are directed either upwards towards the front of the head gear or downwards to light up the face of the wearer of the head gear. The UV LED head gear, used in combination with fluorescent or phosphorescent paint or make-up on the front of the head gear or on wearer's face, will cause the fluorescent or phosphorescent material to glow brightly, as if internally lit, providing an entertaining effect or effective advertising.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
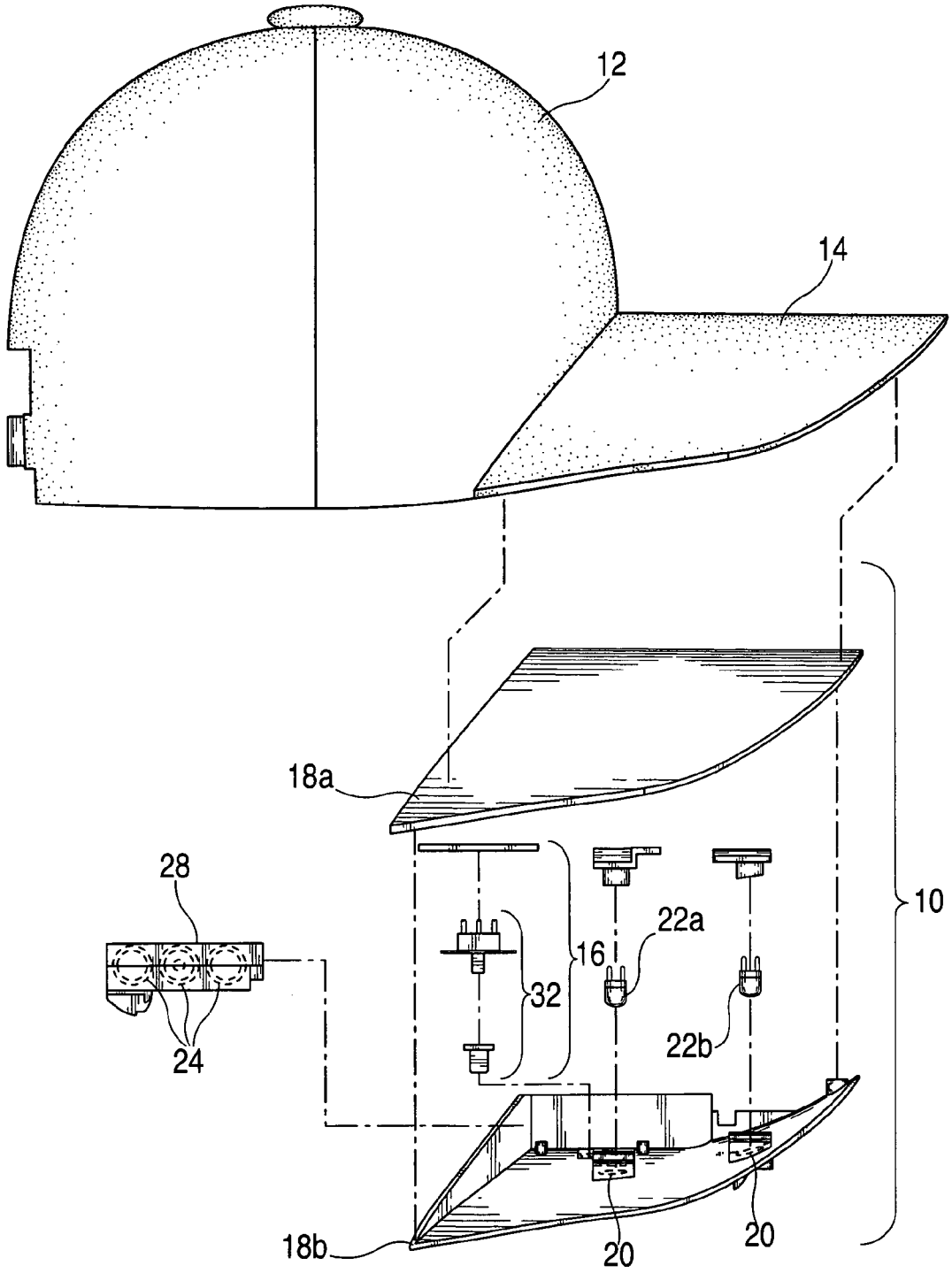
FIG. 1 is an exploded side view of the portable black light device incorporated into a head gear.

With reference to the drawings, wherein the same reference number indicates the same element throughout, there is shown in FIG. 1 a portable black light device 10 of the present invention. Portable black light device 10 is incorporated into a head gear such as a baseball cap 12 having a visor 14 as shown in FIG. 1. FIG. 1 is an exploded view of one half of the black light device 10 for simplification. The other half of the black light device 10 is identical except without power control 16.

Figure 2:
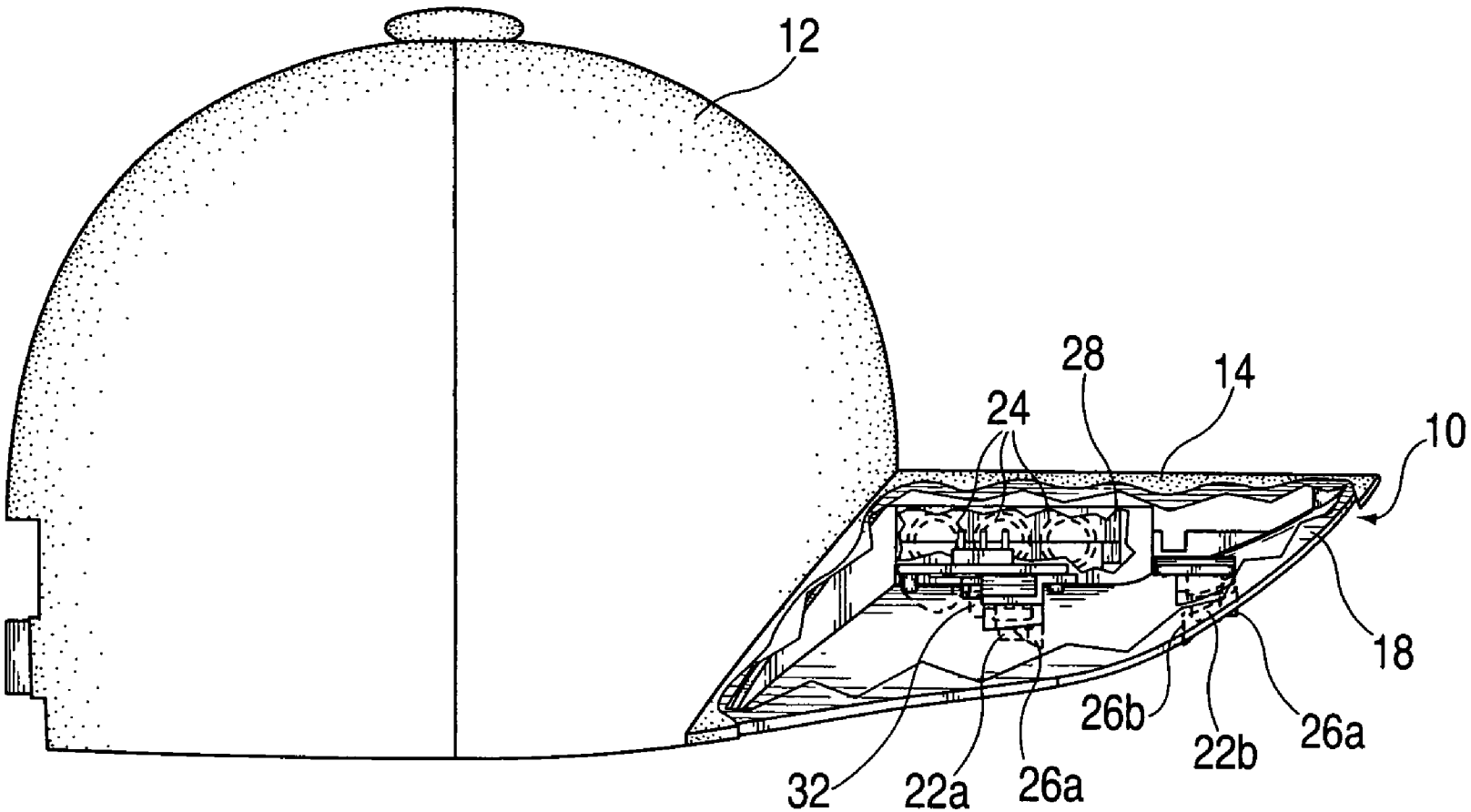
FIG. 2 is a partially cutaway side view of FIG. 1 with the components assembled.
Figure 3:
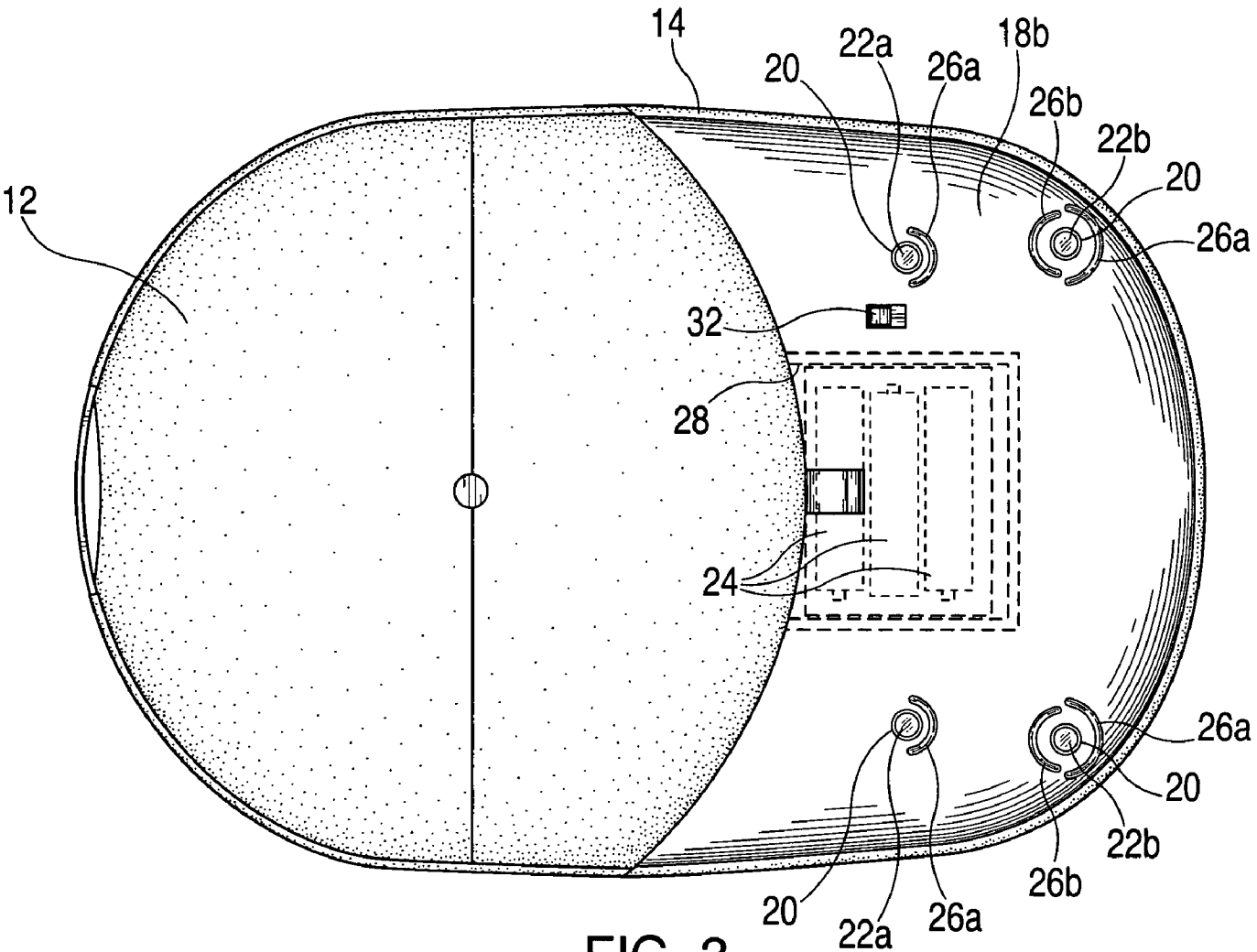
FIG. 3 is a bottom plan view.

As shown in FIGS. 1–3, the portable black light device 10 shown in FIG. 1 comprises a housing 18 having an upper portion 18*a* and a lower portion 18*b* having four (4) openings 20, four (4) UV LEDs 22 and a power source 24.

Housing 18 preferably has the shape and color of the visor 14 of cap 12 such that the black light device 10 is not apparently visible to others. The upper portion 18*a* of housing 18 is attached to the visor 14 by any attaching means known to one skill in the art, such as adhesive, sewing, molding, etc. Similarly, the lower portion 18*b* of housing 18 is attached to the upper portion 18*a* by any attaching means known to one skill in the art, such as adhesive, screws, friction, hooks and latches, etc. Contained within the housing 18 are four (4) UV LEDs 22, power source 24 and power control 16.

Protruding slightly from each opening 20 of the lower portion 18*b* of housing 18 is a UV LED 22. In the preferred embodiment, four (4) UV LEDs 22 are used. A pair of UV LEDs 22*a*, each having a 180 degree spread, are closer to a wearer's face. Another pair of UV LEDs 22*b*, each having a 90 or 120 degree spread, are further from a wearer's face. The difference in the UV LEDs' degree spread is to maximize and balance the intensity and coverage of the UV LEDs. Wider spread UV LEDs 22*a* are used nearer a wearer's face to ensure coverage of the wearer's entire forehead and edge of the nose. Narrower spread UV LEDs 22*b* are used further from a wearer's face to ensure coverage of the wearer's cheeks and beyond. Different combination of UV LEDs 22 with different degree spreads can be used. Each UV LEDs 22 is positioned at a predetermined angle to maximize coverage of the wearer's face.

Adjacent each opening 20 is at least one protruding lip 26. Although UV lights generated from UV LEDs 22 are less than the amount of UV lights experienced during a shady day, protruding lips 26 minimize the UV exposure to a wearer and others. Protruding lips 26*a* adjacent to the side of opening 20 further from a wearer's face are for concealing UV LEDs 22 from others and for minimizing exposure to others. Protruding lips 26*b* adjacent to the side of opening 20 closer to a wearer's face are to shield the UV lights from the wearer's eyes to minimize exposure. Protruding lips 26*b* are not necessary for UV LEDs 22*a* because the UV LEDs 22*a* are sufficiently closed to a wearer's face that most of the UV lights are blocked by a wearer's eye brows.

Power source 24 is self-contained within housing 18. In the preferred embodiment, power source 24 comprises a compartment 28 for storing a plurality of batteries, such as three (3) AAA-size batteries (not shown), that removably engages a slot 30 in housing 18. Compartment 28 is retained within slot by any retaining means known to one skill in the art such as latch and hook, friction, etc. Power control 16, including a switch 32, controls the on-off power to the UV LEDs 22. Electronic circuitries for connecting the power source 24 and power control 16 to each UV LEDs 22 are known to one skill in the art and are not shown to simplify the drawings.

Figure 4:
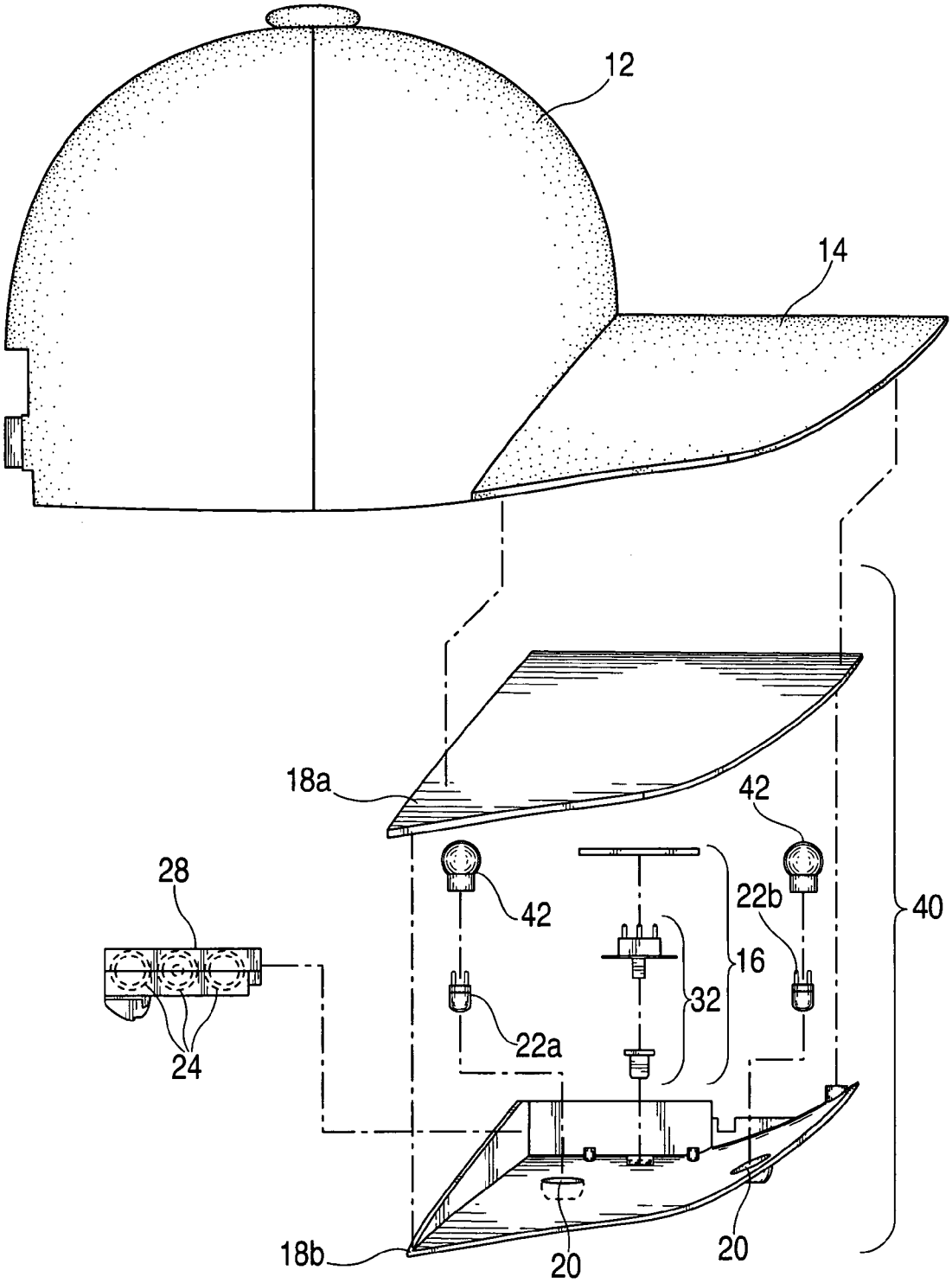
FIG. 4 is an exploded side view of a second embodiment of the portable black light device incorporated into a head gear.
Figure 5:
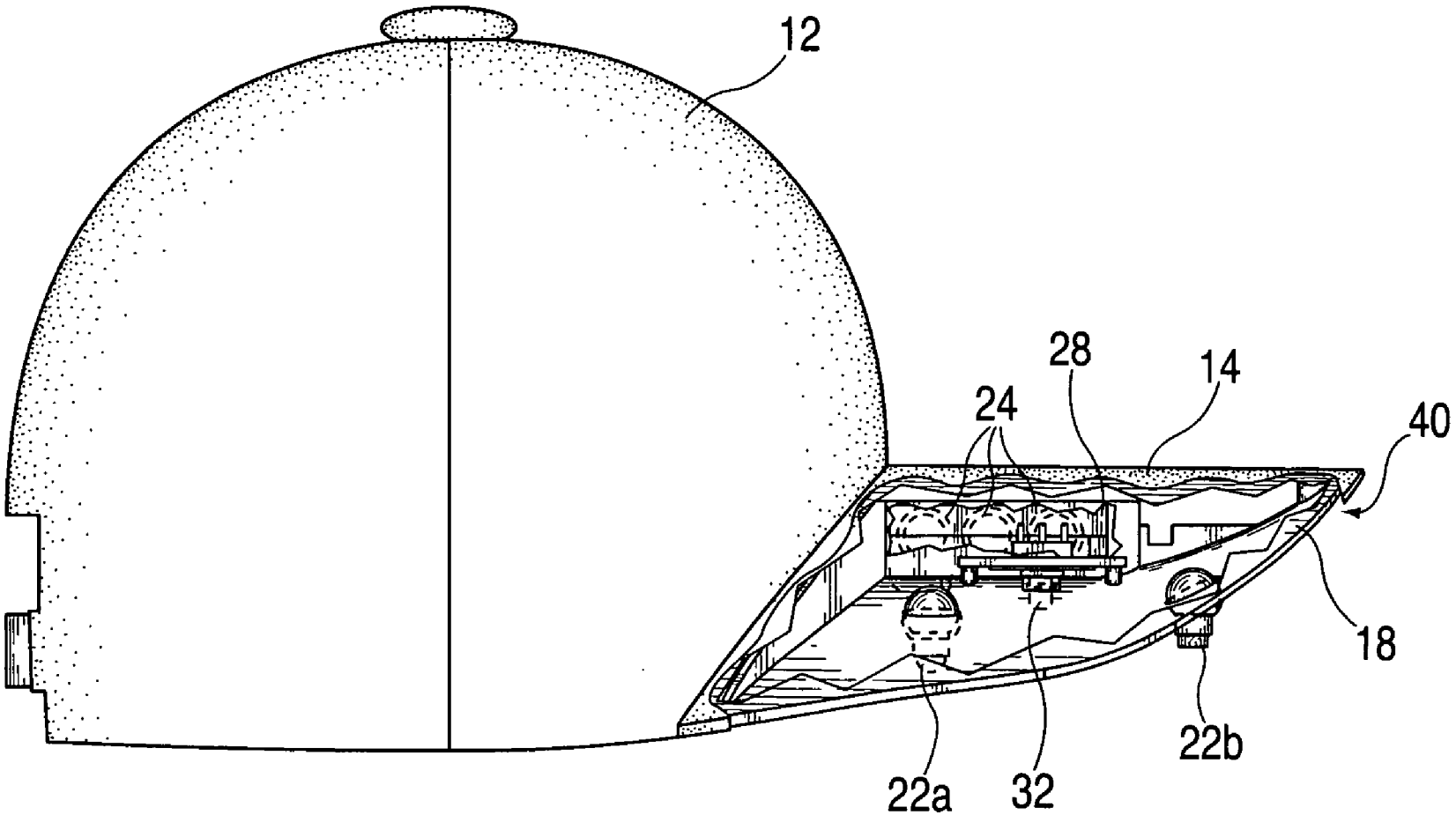
FIG. 5 is a partially cutaway side view of FIG. 3 with the components assembled.
Figure 6:
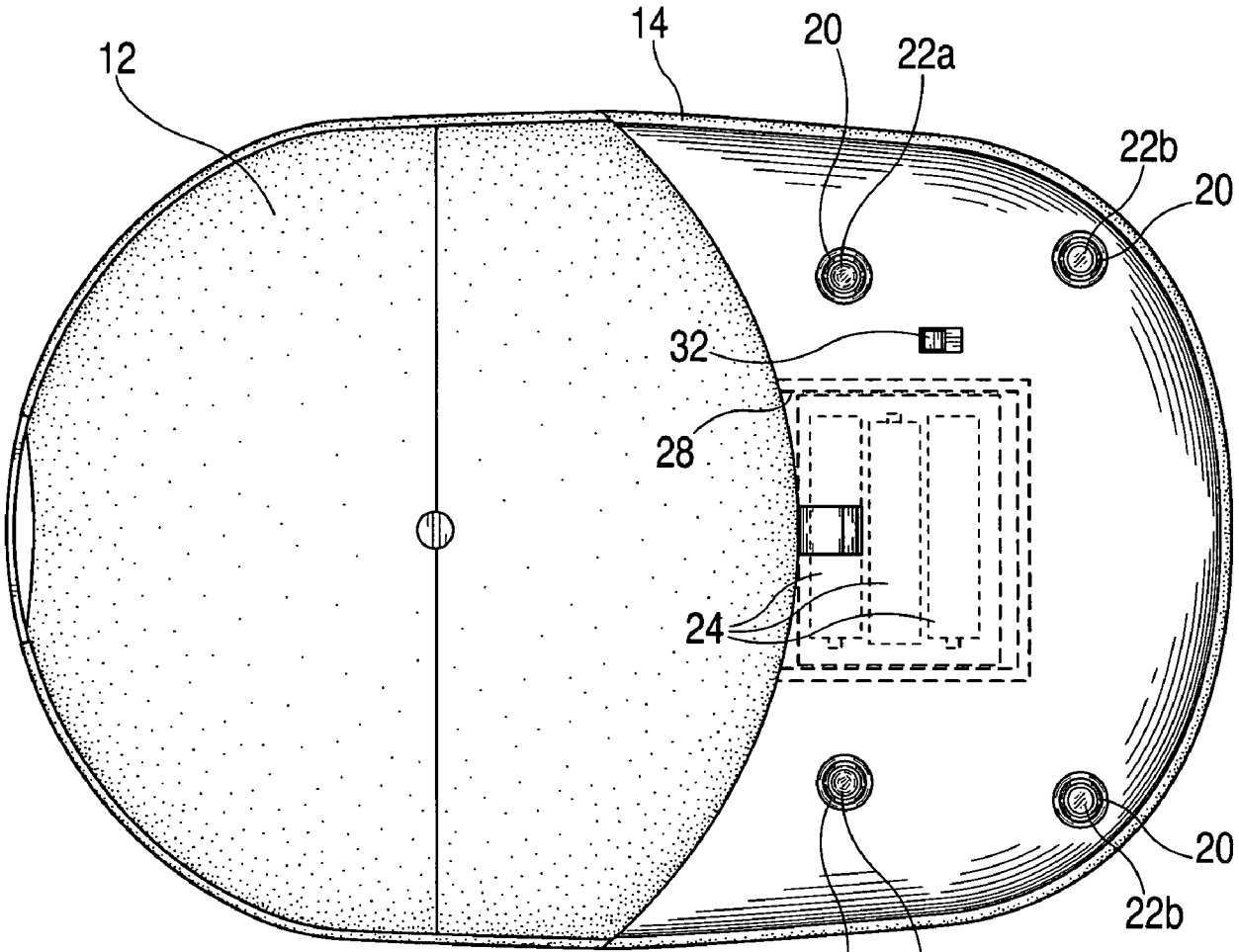
FIG. 6 is a bottom plan view.

FIGS. 4–6 show another embodiment of the portable black light device 40 incorporated into a head gear such as a baseball cap 12 having a visor 14. FIG. 4 is an exploded view of one half of the black light device 40 for simplification. The other half of the black light device 40 is identical except without power control 16.

The portable black light device 40 is identical to the portable black light device 10 of FIGS. 1–4 except that the UV LEDs 22 are pivotable to different angles. Each UV LEDs 22 is first mounted flushed within a ball pivot 42, which then protrudes slightly from each opening 20 of the lower portion 18*b* of housing 18. The mounting of the UV LEDs 22 flushed within the ball pivot 42 eliminates the need for protruding lips 26. Furthermore, the pivoting UV LEDs 22 advantageously can be customized to each wearer's face to ensure maximum coverage by the UV lights.

Figure 7:
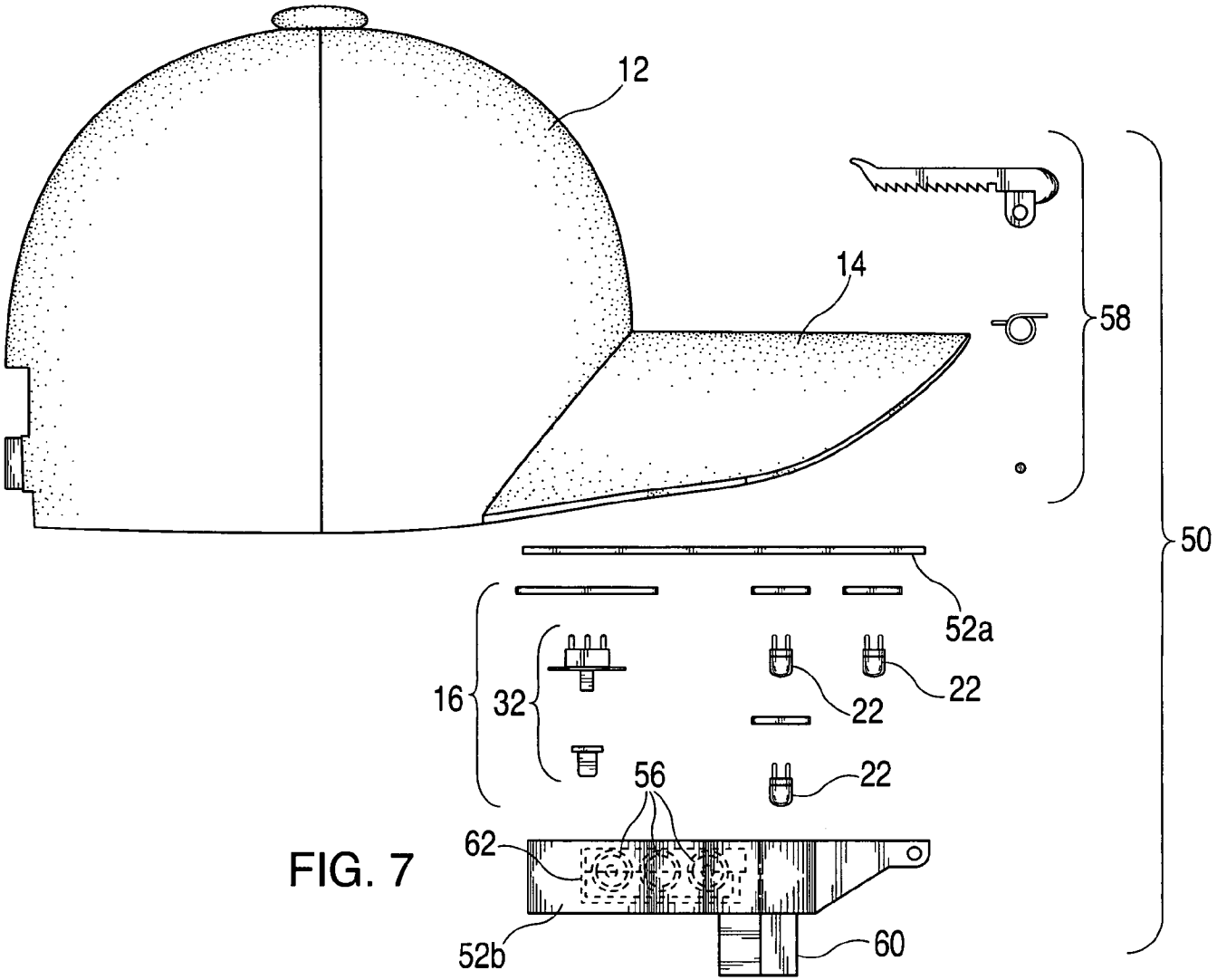
FIG. 7 is an exploded side view of a third embodiment of the portable black light device adaptable to a head gear.
Figure 8:
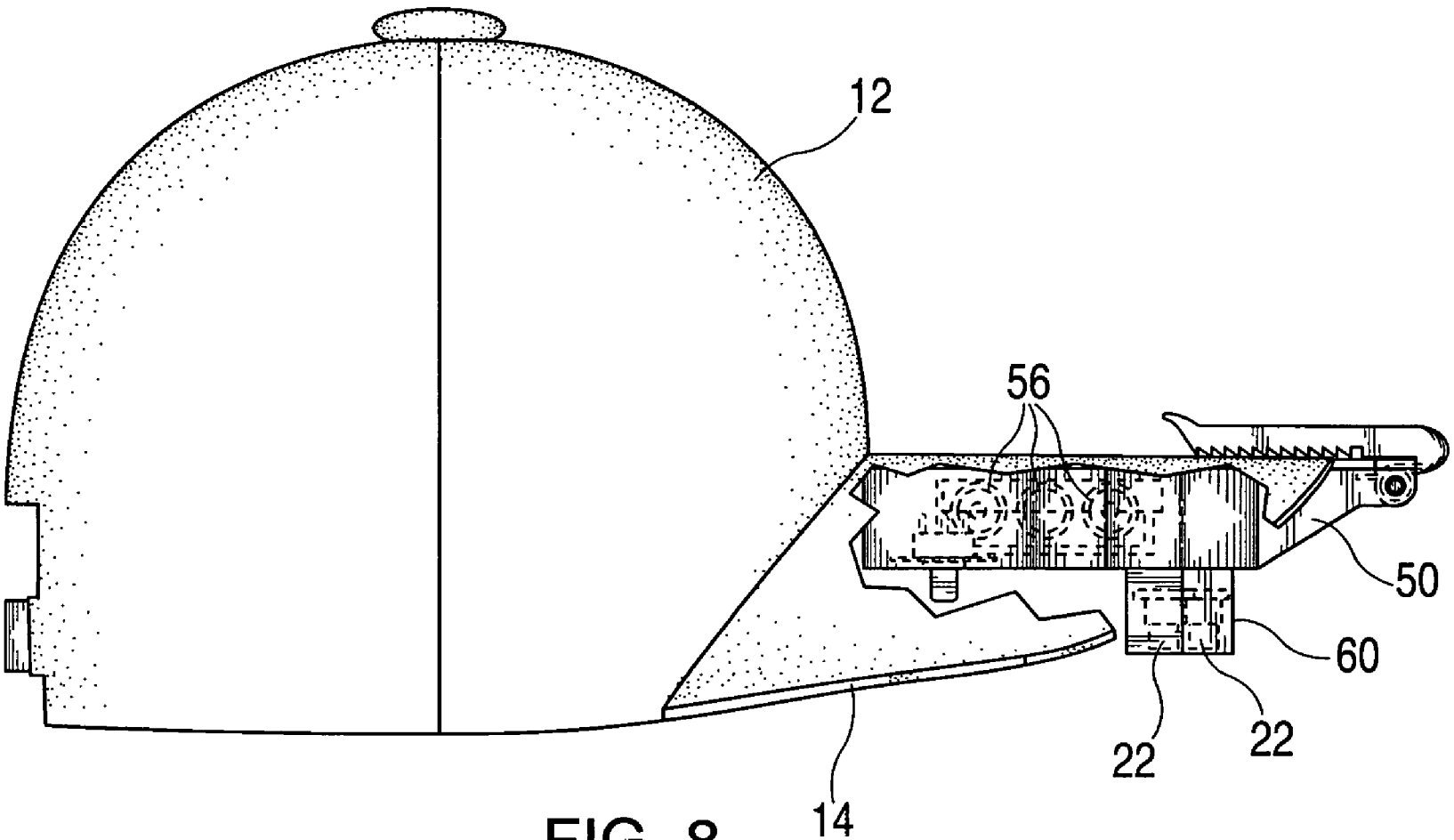
FIG. 8 is a partially cutaway side view of FIG. 7 with the components assembled.
Figure 9:
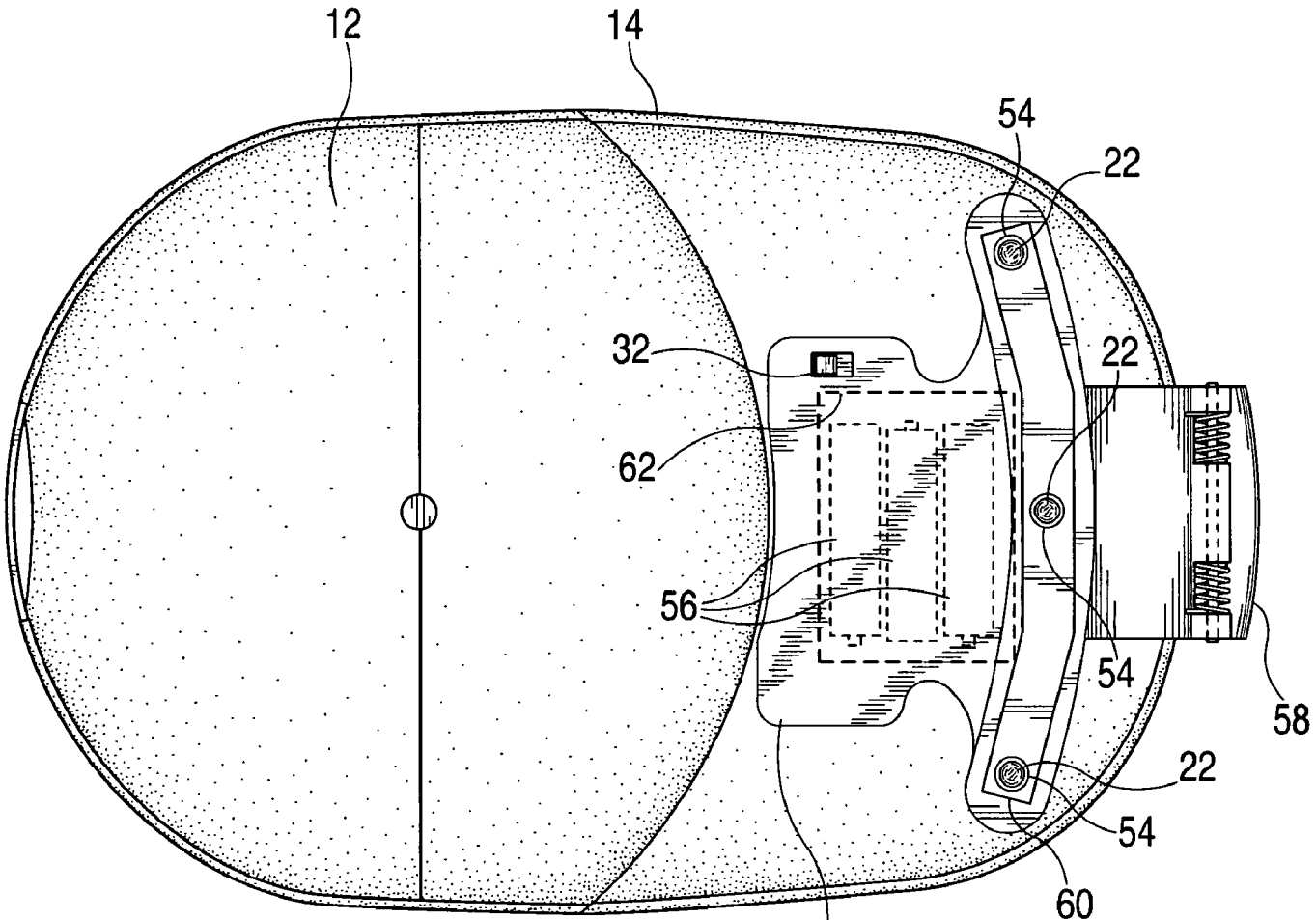
FIG. 9 is a bottom plan view.

FIGS. 7–9 show another embodiment of the portable black light device 50 adaptable to a head gear such as a baseball cap 12 having a visor 14. The portable black light device 50 shown in FIGS. 7–9 comprises a housing 52 having an upper portion 52*a* and a lower portion 52*b* having three (3) openings 54, three (3) UV LEDs 22 and a power source 56.

Housing 52 has a spring actuated clamping member 58 at the upper portion 52*a* of the housing 52 for removably attaching the portable black light device 50 to the visor 14 of cap 12. Other removably attaching means, such as hooks and loops, etc., known to one skill in the art can be used. An arched channel 60 is provided on the lower portion 52*b* of housing. Contained within the housing 52 are three (3) UV LEDs 22, power source 56 and power control 16.

Protruding slightly from each opening 20 in the arched channel 60 is a UV LED 22. Although the UV LEDs 22 is shown to be fixedly mounted as in the embodiment shown in FIGS. 1–3, pivotable UV LEDs 22 as in the embodiment shown in FIGS. 4–6 may be used in this embodiment.

Power source 56 is self-contained within housing 52. The power source 56 comprises a compartment 62 for storing a plurality of batteries (not shown) in housing 52. Power control 16, including a switch 32, controls the on-off power to the UV LEDs 22. Electronic circuitries for connecting the power source 56 and power control 16 to each UV LEDs 22 are known to one skill in the art and are not shown to simplify the drawings.

With a wearer having fluorescent or phosphorescent paint or make-up on his/her face, the portable black light device 10, 40 or 50 causes the designs drawn with fluorescent or phosphorescent paint or make-up glow as if internally lit, providing an entertaining effect or an effective advertising. As the UV light is localized on a wearer's face, the glowing effect is visible even in a well lit environment. Depending on the ambient light condition and the intensity of the UV LEDs 22, the black light may effective light the wearer's clothing and anything placed in front of the wearer. The portable black light device 10, 40 or 50 may be used by a sport fan during a sporting event, with a sport team's colors and/or logos drawn with fluorescent or phosphorescent paint/make-up on the wearer's face. Other uses include for advertising purposes, during Halloween, Independence Day, etc.

Figure 10:
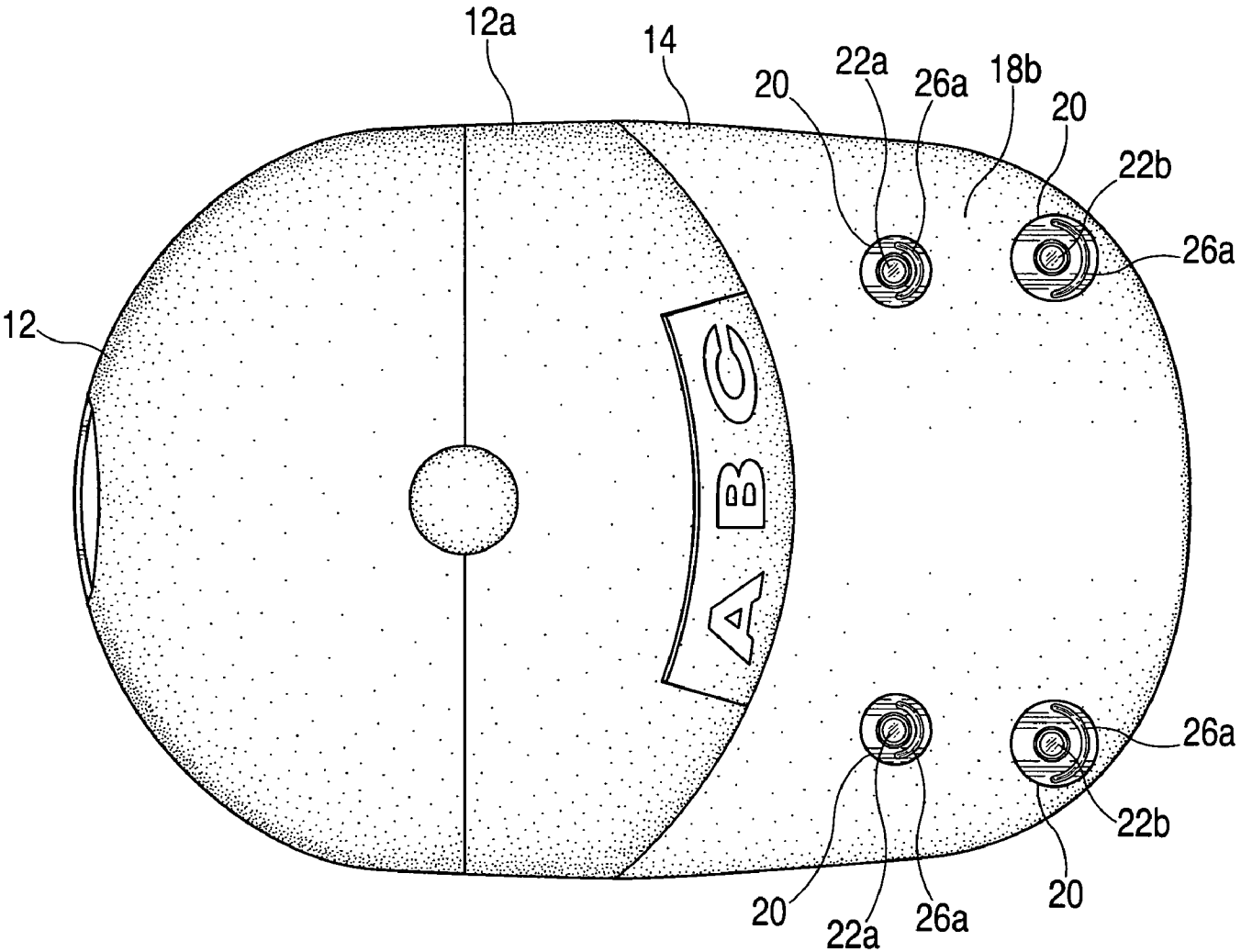
FIG. 10 is a top plan view of a fourth embodiment of the portable black light device incorporated into a head gear.

Although the embodiments described above have the UV LEDs 22 and openings 20 or 54 in the lower portion 18*b* or 52*b* of the housing 18 or 52, the UV LEDs 22 and openings 20 or 54 can also be in the upper portion 18*a* or 52*a* of the housing 18 or 52. As shown in FIG. 10, UV LEDs 22 and openings 20 protrude through the visor 14 or brim of a head gear 12, with the UV LEDs 22 directed towards the main body 12*a* of the cap 12. Advertisement, logos, etc. 64 marked with fluorescent or phosphorescent paint on the main body 12*a* of the cap 12 can be lit by the UV LEDs 22 for effective promotion or marketing.

Figure 11A:
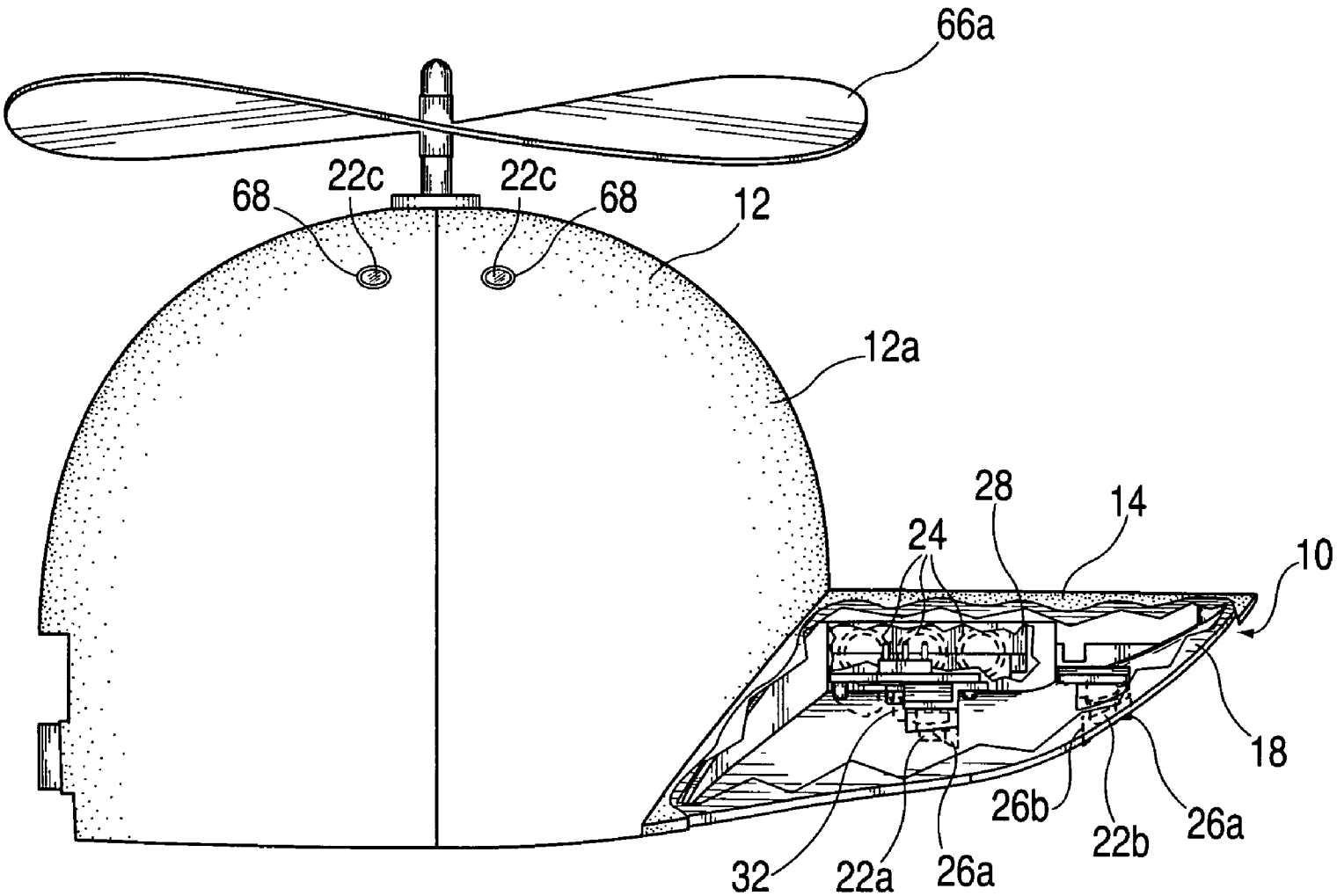
FIGS. 11A–11C are side views of the combination portable black light device and head gear with different decorative elements.
Figure 11B:
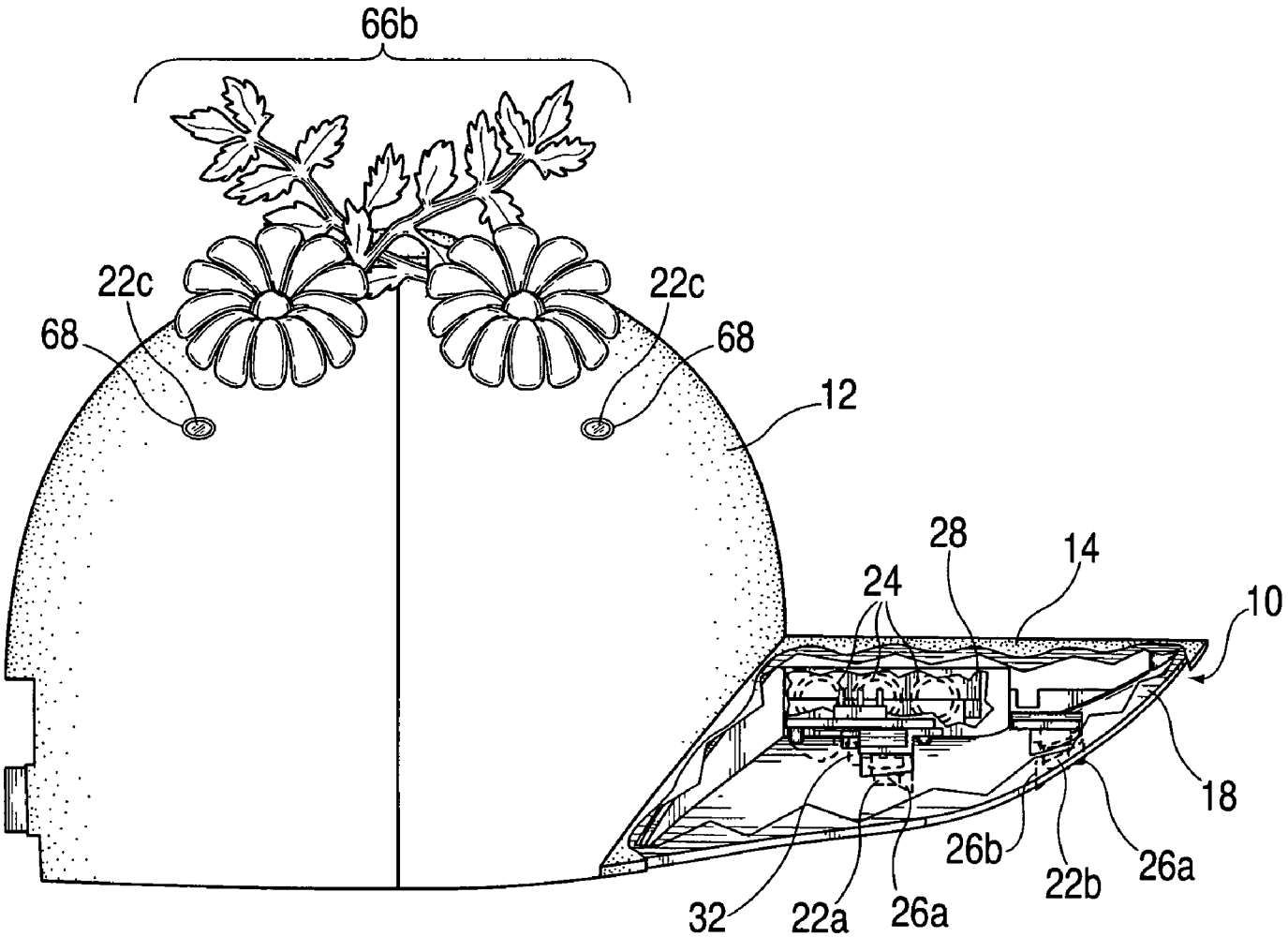
Figure 11C:
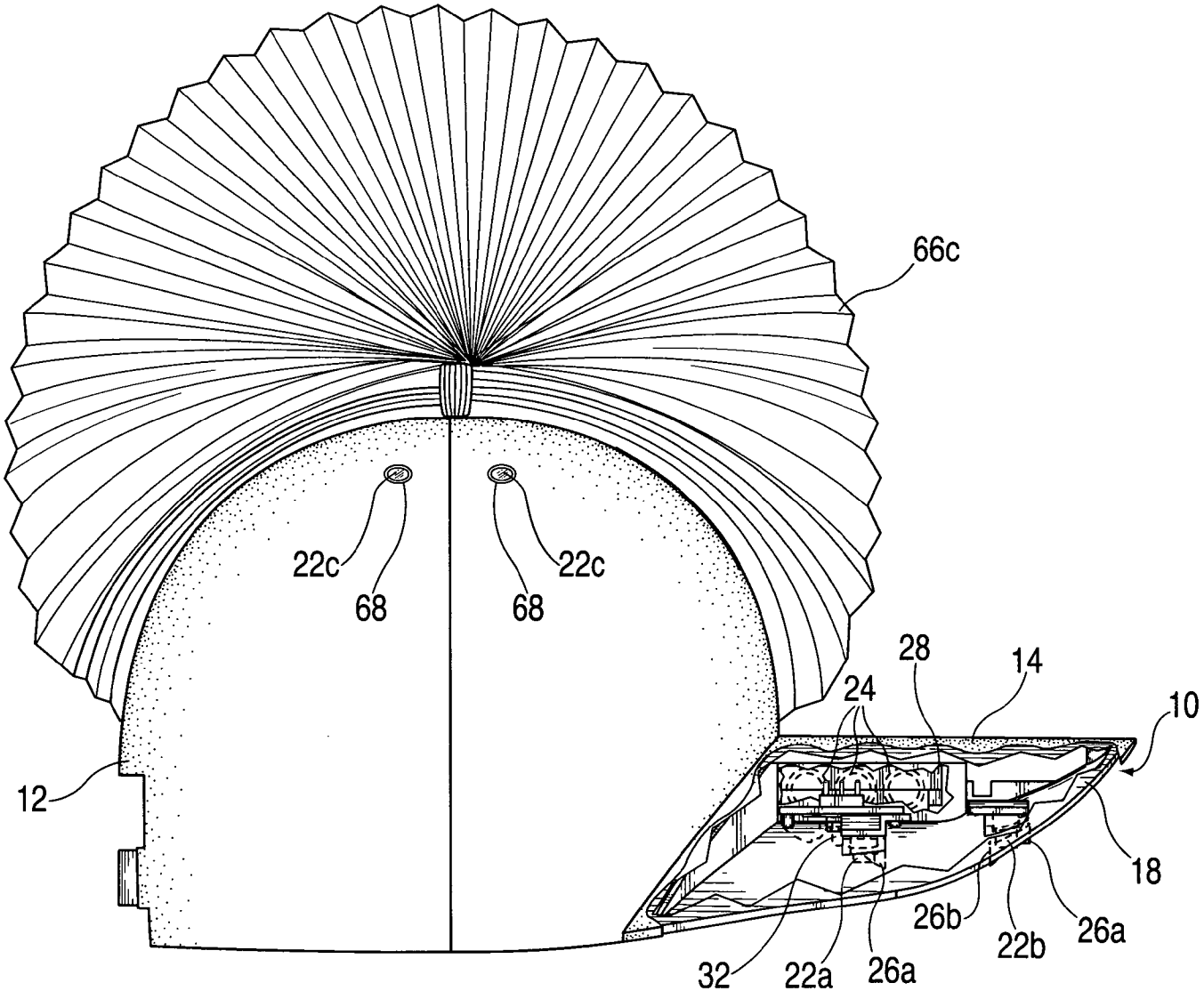

As shown in FIGS. 11A–11C, alternative to having advertisement or logos 64, the main body 12*a* of the cap 12 may have decorative element 66 made of or painted with a fluorescent or phosphorescent material that can be lit up by the UV LEDs. Decorative element 66 may be a propeller 66*a*, silk or plastic flowers 66*b*, a fan 66*c* such as that disclosed in U.S. Pat. Nos. 5,903,926, 6,256,796 and 6,357,052, etc. For the appropriate illumination of the decorative attachment 66, openings 68 and UV LEDs 22*c* are positioned on the main body 12*a* of the cap 12, with the UV LEDs 22*c* directed towards the decorative attachment 66. Wires connecting the UV LEDs 22 to the housing 18 are provided as known to one skill in the art and are not shown. UV LEDs 22*c* may be used in combination of UV LEDs on the visor 14 or brim of the cap 12 that are directed upwards as shown in FIG. 10 to provide sufficient illumination of the decorative element 66.

Although the embodiments described above have either three (3) or four (4) UV LEDs arranged in a particular fashion, more or less UV LEDs arranged in any fashion may be used to provide the necessary coverage and/or intensity.

Although the embodiments described above relates to a baseball cap 12, it is understood that the portable black light device 10, 40 or 50 may be incorporated into any head gears such as visors and other hats with brims. Furthermore, the portable black light device 50 may be removably attached to any surface to provide UV black light.

The features of the invention illustrated and described herein is the preferred embodiment. Therefore, it is understood that the appended claims are intended to cover the variations disclosed and unforeseeable embodiments with insubstantial differences that are within the spirit of the claims.

What I claim is:

1. A portable black light device for incorporating into a head gear having a visor or a brim with a predetermined shape, comprising:

a) a portable housing having substantially the same predetermined shape;

b) a plurality of openings on said housing;

c) a plurality of UV LEDs, one UV LED in each opening facing outwardly from said opening; and d) a power source within the housing for energizing each of said UV LEDs.

2. The device of claim 1 for incorporating into a head gear having a visor or a brim with a predetermined color, wherein said housing has substantially the same predetermined color.

3. The device of claim 1 for incorporating into a head gear having a visor or a brim, further comprising means for attaching said upper portion of said housing to said visor or said brim.

4. The device of claim 3 wherein said attaching means comprises adhesives.

5. The device of claim 3 wherein said attaching means comprises sewing.

6. The device of claim 1 further comprising a power control for selectively energizing said plurality of UV LEDs.

7. The device of claim 1 wherein said portable housing having an upper portion and a lower portion and said plurality of openings are on said lower portion.

8. A portable black light device comprising:

a) a portable housing having an upper portion and a lower portion;

b) a plurality of openings on said housing on said upper portions;

c) a plurality of UV LEDs, one UV LED in each opening facing outwardly from said opening; and d) a power source within the housing for energizing each of said UV LEDs;

9. A portable black light device for incorporating into a head gear having a visor or a brim with a first side adjacent said head gear and a second side opposite said head gear, comprising:

a) a portable housing;

b) four openings on said housing, two of said openings are equidistant from said first side of said visor or said brim and the other two of said openings are equidistant from said second side of said visor or said brim;

c) a plurality of UV LEDs, one UV LED in each opening facing outwardly from said opening; and d) a power source within the housing for energizing each of said UV LEDs.

10. The device of claim 9 comprising four UV LEDs, wherein each of said two of said UV LEDs at said two openings equidistant from said first side of said visor or said brim has a 180 degree spread and each of the other two of said UV LEDs has at the other two openings equidistant from said second side of said visor or said brim a 120 degree spread.

11. The device of claim 9 comprising four UV LEDs, wherein each of said two of said UV LEDs at said two openings equidistant from said first side of said visor or said brim has a 180 degree spread and each of the other two of said UV LEDs has at the other two openings equidistant from said second side of said visor or said brim a 90 degree spread.

12. The device of claim 1 further comprising at least one protruding lip adjacent each of said plurality of openings.

13. The device of claim 9 further comprising at least one protruding lip adjacent each of said four openings, wherein one protruding lip is adjacent each of said four openings on said second side of said visor or said brim and one protruding lip is adjacent each of said two openings equidistant from said second side of said visor or said brim on said first side of said visor or said brim.

14. The device of claim 1 wherein said power source comprises a compartment for storing a plurality of batteries.

15. The device of claim 14 wherein said housing further comprises a slot for removably engaging said power source.

16. The device of claim 6 wherein said power control comprises a switch.

17. A portable black light device, comprising:

a) a portable housing;

b) a plurality of openings on said housing;

c) a plurality of UV LEDs in each opening facing outwardly from said opening;

d) a power source within the housing for energizing each of said UV LEDs; and e) plurality of ball pivot for mounting each of said plurality of UV LEDs at each of said plurality of openings such that each of said plurality of UV LEDs is pivotable to different angles.

18. The device of claim 1 for adapting to a head gear having a visor or a brim, further comprising means for removably attaching said device to said visor or said brim of said head gear.

19. A portable black light device for adapting to a head gear having a visor or a brim, comprising:

a) a portable housing;

b) a plurality of openings on said housing;

c) a plurality of UV LEDs in each opening facing outwardly from said opening;

d) a power source within the housing for energizing each of said UV LEDs; and e) means for removably attaching said device to said visor or said brim of said head gear;

wherein said removably attaching means comprises a spring actuated clamping member at the upper portion of said housing.

20. The device of claim 18 wherein said removably attaching means comprises hooks and loops.

21. A portable black light device, comprising:

a) a portable housing having an upper portion and a lower portion;

b) a plurality of openings on said lower portion of said housing;

c) a plurality of UV LEDs, one UV LED in each opening facing outwardly from said opening;

d) a power source within the housing for energizing each of said UV LEDs; and e) an arched channel on said lower portion of said housing and each of said plurality of openings is within said arched channel.

22. A portable black light device, comprising:

a) a portable housing having an upper portion and a lower portion;

b) a plurality of openings on said upper portion of said housing;

c) a plurality of UV LEDs, one UV LED in each opening facing outwardly from said opening;

d) a power source within the housing for energizing each of said UV LEDs; and e) arched channel on said upper portion of said housing and each of said plurality of openings is within said arched channel.

23. The combination of a portable black light device and at least one fluorescent paint for making a marking on a surface, comprising:

a) at least one fluorescent paint for making a marking on a surface;

b) a portable housing;

c) a plurality of openings on said housing facing said marking;

d) a plurality of UV LEDs, one UV LED in each opening facing outwardly from said opening for lighting said marking; and e) a power source within the housing for energizing each of said UV LEDs.

24. The combination of a portable black light device and at least one phosphorescent paint for making a marking on a surface, comprising:

a) at least one phosphorescent paint for making a marking on a surface;

b) a portable housing;

c) a plurality of openings on said housing facing said marking;

d) a plurality of UV LEDs, one UV LED in each opening facing outwardly from said opening for lighting said marking; and e) a power source within the housing for energizing each of said UV LEDs.

25. The combination of a portable black light device for adapting to a head gear having a visor or a brim for a wearer and at least one fluorescent paint for making a marking on the wearer's face, comprising:

a) at least one fluorescent paint for making a marking on a said wearer's face;

b) a portable housing;

c) means for attaching said housing to said visor or said brim;

d) a plurality of openings on said housing facing said marking;

e) a plurality of UV LEDs, one UV LED in each opening facing outwardly from said opening for lighting said marking; and f) a power source within the housing for energizing each of said UV LEDs.

26. The combination of a portable black light device and a head gear, comprising:

a) a head gear having a visor or a brim, b) a portable housing;

c) means for attaching said housing to said visor or said brim;

d) a plurality of openings on said housing;

e) a first set of a plurality of UV LEDs, one UV LED of said first set of a plurality of UV LEDs in each opening facing outwardly from said opening; and f) a power source within the housing for energizing each of said UV LEDs.

27. The combination of a portable black light device and a head gear, comprising:

a) a head gear having a visor or a brim and a main body connected to said visor or brim and a marking on said main body of said head gear, b) a portable housing;

c) means for attaching said housing to said visor or said brim;

d) a plurality of openings on said housing;

e) a first set of a plurality of UV LEDs, one UV LED of said first set of plurality of UV LEDs in each opening facing outwardly from said opening; and f) a power source within the housing for energizing each of said UV LEDs;

wherein said marking is made by a fluorescent paint and said plurality of UV LEDs are directed towards said marking for lighting said marking.

28. The combination of a portable black light device and a head gear, comprising:

a) a head gear having a visor or a brim and a main body connected to said visor or brim and a marking on said main body of said head gear, b) a portable housing;

c) means for attaching said housing to said visor or said brim;

d) a plurality of openings on said housing;

e) a first set of a plurality of UV LEDs, one UV LED of said first set of plurality of UV LEDs in each opening facing outwardly from said opening; and f) a power source within the housing for energizing each of said UV LEDs;

wherein said marking is made by a phosphorescent paint and said plurality of UV LEDs are directed towards said marking for lighting said marking.

29. The combination of a portable black light device and a head gear, comprising:

a) a head gear having a visor or a brim;

b) a portable housing;

c) means for attaching said housing to said visor or said brim;

d) a plurality of openings on said housing;

e) a first set of a plurality of UV LEDs, one UV LED of said first set of plurality of UV LEDs in each opening facing outwardly from said opening;

f) a power source within the housing for energizing each of said UV LEDs; and g) at least one decorative element made of fluorescent material attached to said head gear, wherein said plurality of UV LEDs are directed towards said at least one decorative element for lighting said at least one decorative element.

30. The combination of a portable black light device and a head gear, comprising:

a) a head gear having a visor or a brim;

b) a portable housing;

c) means for attaching said housing to said visor or said brim;

d) a plurality of openings on said housing;

e) a first set of a plurality of UV LEDs, one UV LED of said first set of plurality of UV LEDs in each opening facing outwardly from said opening;

f) a power source within the housing for energizing each of said UV LEDs; and g) at least one decorative element made of phosphorescent material attached to said head gear, wherein said plurality of UV LEDs are directed towards said at least one decorative element for lighting said at least one decorative element.

31. The combination of claim 29 further comprising a plurality of openings on said head gear and a second set of a plurality of UV LEDs, one UV LED of said second set of a plurality of UV LEDs in each of said opening on said head gear facing outwardly from said opening on said head gear towards said decorative element.

32. The combination of claim 30 further comprising a plurality of openings on said head gear and a second set of a plurality of UV LEDs, one UV LED of said second set of a plurality of UV LEDs in each of said opening on said head gear facing outwardly from said opening on said head gear towards said decorative element.

* * * * *